United States Patent [19]

Nissen

[11] 3,938,792

[45] Feb. 17, 1976

[54] PROTECTIVE END COVERS FOR THE RESILIENT SUSPENSION MEMBERS OF TRAMPOLINE BEDS AND THE LIKE

[75] Inventor: George P. Nissen, Cedar Rapids, Iowa

[73] Assignee: Nissen Corporation, Cedar Rapids, Iowa

[22] Filed: Oct. 18, 1974

[21] Appl. No.: 515,823

Related U.S. Application Data

[62] Division of Ser. No. 462,662, April 22, 1974, Pat. No. 3,869,120.

[52] U.S. Cl. ..... 267/69; 267/74

[51] Int. Cl.[2] ..... F16F 1/46

[58] Field of Search ..... 267/69, 73, 74, 129; 272/65

[56] References Cited

UNITED STATES PATENTS

| | | | |
|---|---|---|---|
| 1,229,441 | 6/1917 | Griffin | 267/74 |
| 3,041,060 | 6/1962 | Jacobsen | 267/73 |
| 3,233,895 | 2/1966 | Grelle et al. | 272/65 |

*Primary Examiner*—James B. Marbert
*Attorney, Agent, or Firm*—Haven E. Simmons; James C. Nemmers

[57] ABSTRACT

The hooked ends of the springs or like members by which the bed of a trampoline or similar apparatus is suspended from its frame are equipped with protective sleeves of flexible material. The sleeves are split at their outer ends to form two flaps, one of which covers the exposed ends of the hooks to prevent injury to a performer inadvertently striking them, while the two flaps together are foldable back onto the sleeve to assist hooking and unhooking of the springs to and from the bed and the frame.

1 Claim, 3 Drawing Figures

PROTECTIVE END COVERS FOR THE RESILIENT SUSPENSION MEMBERS OF TRAMPOLINE BEDS AND THE LIKE

This is a division of application Ser. No. 462,662 filed Apr. 22, 1974 now U.S. Pat. No. 3,869,120 issued Mar. 4, 1975.

BACKGROUND OF THE INVENTION

As is well known, the bed of a trampoline or similar apparatus is suspended from framework by means of a large number of coil springs or elastic cords to provide the requisite resiliency for the bed. The springs or cords are hooked at one end to the frame members and at the other end to the edges of the bed. So that the springs or cords can be easily replaced or the bed readily detached, simple open hooks are used, formed integrally on the ends of the springs or clamped to the ends of the cords, as the case may be. Invariably, the open ends of the metal hooks are sharp, and though the springs or cords are attached so that the hook ends are generally just to the rear of the working face of the bed, they nevertheless constitute an ever present hazard to a performer should his hand or foot inadvertently slip between adjacent springs or cords. It is not feasible to round over or further blunt the hook ends during their manufacture owing to the time and effort that would be involved and the great number of springs or cords required. Even were that done, there is doubt whether it would really be sufficiently effective to preclude injury under the circumstances referred to. Instead, therefore, other approaches have been tried.

One is to dip the hooks so that they, including their ends, are covered with a protective coating of elastomeric nature. The trouble with this, however, is that the coating tends to wear off rather rapidly during use, especially in the areas of the hook which engage the moorings provided for them along the frame members and the edges of the bed. Even at the ends of the hook, the coating is not always adequate, and any severe contact with them tends to cause the metal to tear through and protrude from the coating. Besides, the coating of course increases the diameter of the hooks and thus the difficulty of getting them through the moorings along the bed and the frame unless these are specially enlarged. Another approach has been to cover the hook ends with elastomeric knobs. These would be satisfactory except that they too readily become detached and lost. Some times, even, they are idly pulled off and not replaced by persons standing around the apparatus. In any event, the knobs must be applied after the springs are in place and must be laboriously removed one by one before the springs can be detached.

Despite the fact that the problem has persisted literally for many years no really effective and practical solution has previously emerged. The matter has become more acute owing to impending regulations requiring protective covers for the ends of all springs used on trampolines and like apparatus where injury might otherwise occur. The design of effective such covers, which are both economical to provide and practical to use, is thus the primary object of the present invention.

SUMMARY OF THE INVENTION

The foregoing is achieved by devices which are as completely effective as they are disarmingly simple. Before each spring or cord is hooked into place, short sleeves of flexible material are slipped over each end and encompass both the hooks and the adjacent end portions of the springs or cords. The sleeves fit snugly over the latter, especially in the case of springs whose ends taper in diameter toward the hooks, so that the sleeves are restrained against longitudinal displacement. The wall of each sleeve portion enveloping the hook is slit in two opposite places inwardly from its outer end to provide a pair of flaps, one of which overlies the sharp end of the hook to provide the required protective cover. The two flaps can be folded back along the remainder of the sleeve to expose the hook so that the latter can be readily attached to or detached from, as the case may be, the frame or the bed, all without any need to remove the sleeves beforehand.

The sleeves also provide an additional benefit, especially where springs are used, in that they help prevent injury in the event of spring breakage. Generally, as tests have confirmed, when a spring breaks it does so at the hook rather than at some point along its body. Should a spring break, the sleeve at that end remains in place and thus protectively encloses the sharp, broken end of the spring as it whips back and might otherwise cause injury. Furthermore, regardless of where the break occurs along the spring, the sleeves also act as "keepers" and prevent either portion of the spring from flying off its mooring at the bed or the frame. That otherwise often happens in the case of the broken portion attached to the frame since the breakage usually occurs when the bed is deflected, whereupon owing to the resulting angle of the spring with respect to its mooring on the frame, the hook at that point can fly out of its mooring as the broken portion of the spring snaps back. Finally, the protective sleeves of the present invention are as readily adaptable to apparatus already in the field as to that newly manufactured, so that no replacement parts or other special reworking is needed for the former.

The invention is further explained in the more detailed description which follows, read in conjunction with the attached drawings.

DETAILED DESCRIPTION OF THE PREFERRED EMBODIMENT

Figure 2:
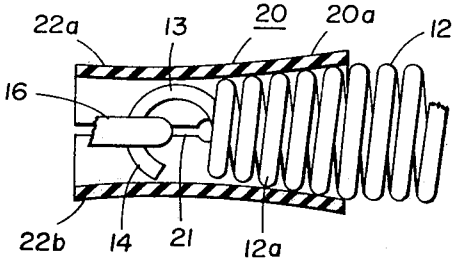
FIG. 2 is a detail view of the end of one spring hooked to the trampoline bed, the protective sleeve being shown in vertical section to illustrate its relation to the end of the spring and its hook.
Figure 1:
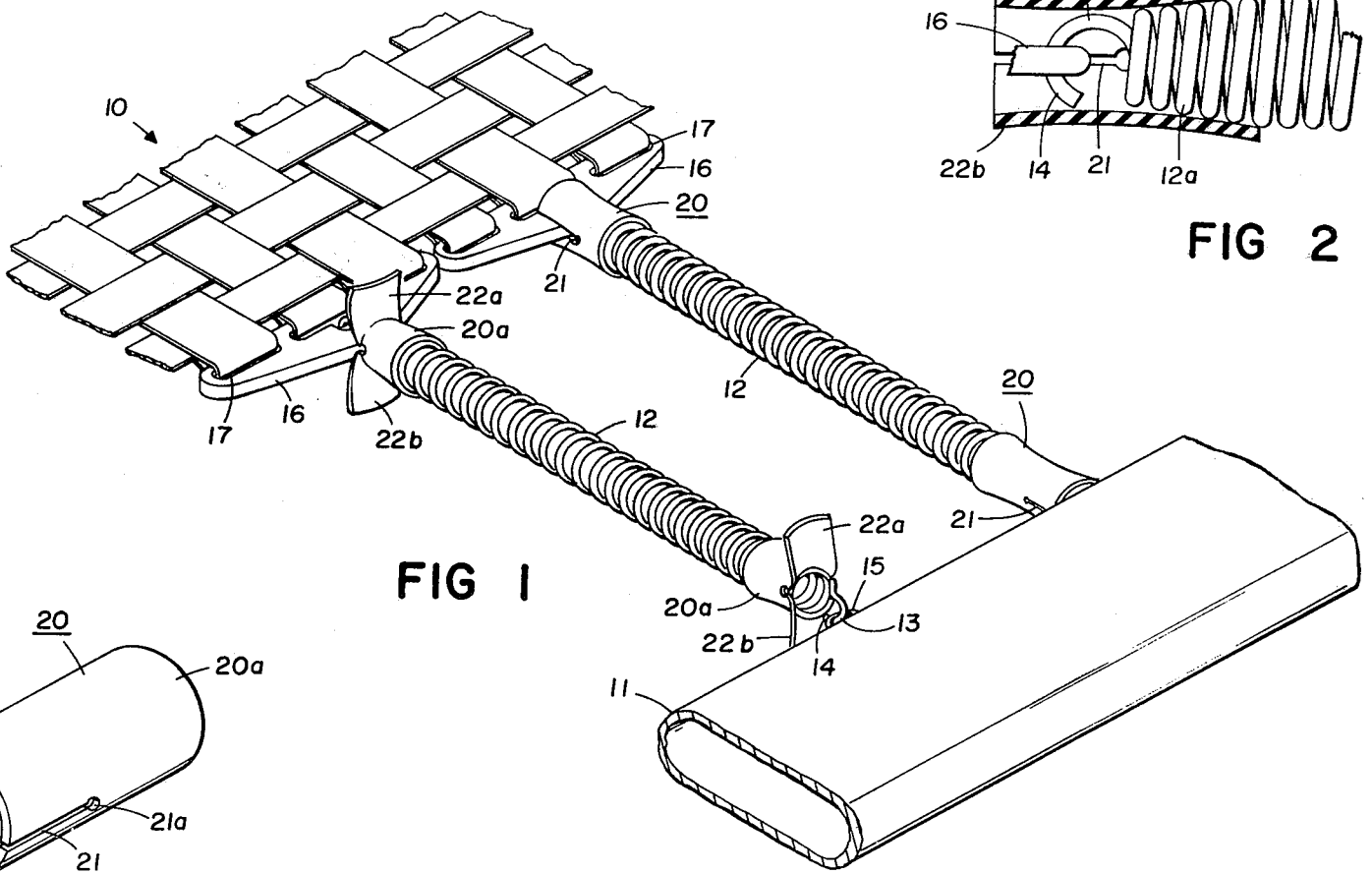
FIG. 1 is a perspective view of a portion of a typical trampoline illustrating a pair of the springs suspending its bed equipped with the protective split sleeves of the present invention, the flaps of the sleeves on one of the springs being shown in their pulled back position to assist hooking or unhooking of the spring.
Figure 3:
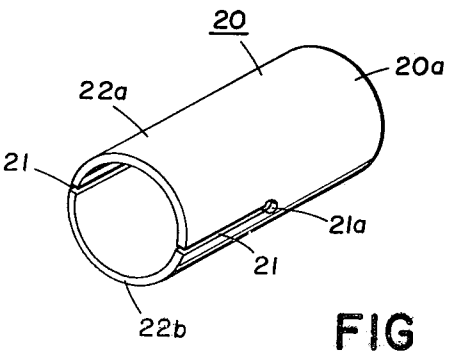
FIG. 3 is an isometric view of one of the protective sleeves.

Referring first to FIG. 1, the webbed trampoline bed 10 is connected to an opposed frame member 11 of flattened oval tubing by means of extensible, helical springs 12 having a hook 13 at each end. The hooks 13 are formed integrally with the bodies of the springs 12 whose ends 12*a* taper in diameter toward the hooks 13 (see FIG. 2). The hooks 13 extend arcuately from and transversely across the spring body ends 12*a* and terminate in open ends 14 which are invariably sharp or sometimes even jagged. At one end the springs 12 are hooked through mooring eyes 15 welded along the inner edge of the frame member 11 and at the other end through delta-shaped mooring bars 16 along the edge of the bed 10 through which its webs are looped at 17. In each case the spring ends 14 point to the rear of the working face of the bed 10. All the foregoing is conventional and well known.

Before each spring 12 is attached, over its ends 12*a* and hooks 13 are slipped short protective sleeves 20 cut from suitable flexible tubing, such as rubber vinyl. The inner sleeve portions 20*a* fit snugly over the tapered body ends 12*a* which restrain the sleeves 20 from slipping back to expose the hooks 13. The walls of the outer portions of the sleeves 20 are slit at 21 at diametrically opposite points inwardly from their ends to form protective flaps 22*a* and 22*b* which, as shown in FIG. 1, are foldable back toward the inner sleeve portions 20*a* to expose the hooks 13 and to assist their hooking and unhooking to and from the frame member 11 and the mooring bar 16. In order to relieve strain, the inner ends of the slits are radiused at 21*a*. As will be observed from FIGS. 1 and 2, the flaps 22*a* and 22*b* substantially entirely encompass the hooks 13, and the flaps 22*b* in particular form complete protective covers over the sharp hook ends 14. Hence, even should a performer's hand, arm, foot or leg inadvertently slip between the springs 12, the sleeves 20 effectively protect him from any contact with the sharp hook ends 14 no matter what the direction of his movement may be between the springs 12. Obvious modifications of size and the like will adapt the sleeves 20 to other forms of springs and to other elastic suspension members, such as shock cord to whose ends similar hooks are clamped or otherwise secured. Accordingly, the present invention provides economical, feasible and yet fully effective protection for hooked ends of suspension members for trampolines or any other rebound apparatus in which such members are used.

Though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. For use with apparatus for rebound of a performer in connection with trampoline, gymnastic and like activities, the apparatus having a frame and a flexible bed resiliently suspended from the frame by a plurality of resiliently extensible members between opposed marginal edges of the frame and the bed, each extensible member having an end portion and an outer hook removably connected to one of said marginal edges, the hook extending transversely across the adjacent end portion of the extensible member and terminating in an exposed hook end subject to contact by a performer, a protective device comprising: a flexible sleeve having two longitudinally adjacent portions, the first portion being adapted to encompass said member end portion to locate the sleeve relative to the extensible member, the wall of the second sleeve portion having a pair of slits therein extending in a longitudinal direction inwardly from the outer end thereof to form a pair of flap portions foldable back toward the first sleeve portion, one of the flap portions being adapted to protectively overlie said hook end.

* * * * *